US007284880B1

(12) United States Patent
Steele

(10) Patent No.: US 7,284,880 B1
(45) Date of Patent: Oct. 23, 2007

(54) SECURITY DEVICE WITH ROTATING FLOODLIGHTS

(76) Inventor: David Steele, 4502 Superior La., Clearwater, FL (US) 33762

( * ) Notice: Subject to any disclaimer, the term of this patent is extended or adjusted under 35 U.S.C. 154(b) by 0 days.

(21) Appl. No.: 11/507,090

(22) Filed: Aug. 21, 2006

(51) Int. Cl.
*F21V 23/04* (2006.01)
*F21V 33/00* (2006.01)

(52) U.S. Cl. ..... 362/276; 362/234; 362/253

(58) Field of Classification Search ..... 362/35, 362/276, 233, 250, 269, 271, 272, 285, 286, 362/802, 418, 419, 420, 449, 372, 238, 239, 362/287, 234, 253
See application file for complete search history.

(56) References Cited

U.S. PATENT DOCUMENTS 2,345,382 A * 3/1944 Cramer ..... 362/35
5,258,899 A 11/1993 Chen
5,335,159 A * 8/1994 Chen et al. ..... 362/421
5,381,323 A * 1/1995 Osteen et al. ..... 362/276
5,473,368 A * 12/1995 Hart ..... 348/155
5,607,217 A 3/1997 Hobbs, II
5,649,761 A 7/1997 Sandell et al.
5,662,411 A * 9/1997 Haslam et al. ..... 362/276
5,867,099 A * 2/1999 Keeter ..... 340/567
5,941,630 A * 8/1999 Finke et al. ..... 362/371
6,030,095 A * 2/2000 Moore et al. ..... 362/645
6,175,309 B1 * 1/2001 Drake et al. ..... 340/545.3
6,741,176 B2 * 5/2004 Ferraro ..... 340/568.1
6,781,129 B2 * 8/2004 Leen ..... 250/342
6,918,683 B2 7/2005 Olson
6,956,493 B1 10/2005 Youngblood

* cited by examiner

*Primary Examiner*—Jong-Suk (James) Lee
*Assistant Examiner*—Edmund Kang
(74) *Attorney, Agent, or Firm*—Thomas Frost

(57) ABSTRACT

A security device with rotating floodlights comprises a housing having a control circuit and a motor positioned within the housing. A motion detector is mounted on the front wall of the housing. A shaft from the motor engages with a drive platform, and a pair of lamp base platforms is connected to a pair of turntables on the top wall of the housing. The turntables are mounted on the top wall of the housing, and are constructed to be rotatable either clockwise or counterclockwise. Lamp sockets for flood lights are attached to the lamp base platforms. Posts are mounted on the base platforms and drive platforms with linkages engaged with the posts. When the motion detector communicates with the control circuit, and the motor and lights are activated, the platforms turn in a synchronized manner because of the linkages. Illumination is provided for a set period of time and over a swept 180° of coverage.

6 Claims, 5 Drawing Sheets

SECURITY DEVICE WITH ROTATING FLOODLIGHTS

BACKGROUND OF THE INVENTION

The present invention relates to a pair of oscillating spotlights which are activated by a motion detector. Once activated the spotlights sweep an area of 180° at a predictable rate and duration.

Spotlights activated by motion detectors are well known in the prior art. Some even have an oscillating feature, U.S. Pat. No. 6,918,683. A disadvantage in the prior art is that the spotlights are either stationary after activation or, when activated, the illuminated control area is not provided with a continuous sweeping by the spotlights.

It is an object of the invention to provide a security device activated by a motion sensor and illuminating a secured area for a set period with a pair of synchronized spotlights.

It is a further object to provide a mountable device which can be connected to existing electrical boxes as needed in a residence.

SUMMARY OF THE INVENTION

The general purpose of the present invention, which will be described subsequently in greater detail, is to provide a new and improved pair of oscillating flood lights which are activated by a motion detector.

To attain this, the present invention comprises a housing having a control circuit and a motor positioned within the housing. A motion detector is mounted on the front wall of the housing. A shaft extends from the top of the motor. There is an opening in the top wall of the housing through which the motor shaft passes and engages with a drive platform.

A pair of lamp base platforms is connected to a pair of turntables. The turntables are mounted on the top wall of the housing, and are constructed to be rotatable either clockwise or counterclockwise. Lamp sockets for flood lights are attached to the lamp base platforms. Posts are mounted on the base platforms and drive platforms with linkages engaged with the posts.

When the motion detector, or alternatively a user with a remote control, activates the motor and lights, the platforms turn in a synchronized manner because of the linkages. The lights thus sweep a pre-determined area for a pre-determined period of time.

BRIEF DESCIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
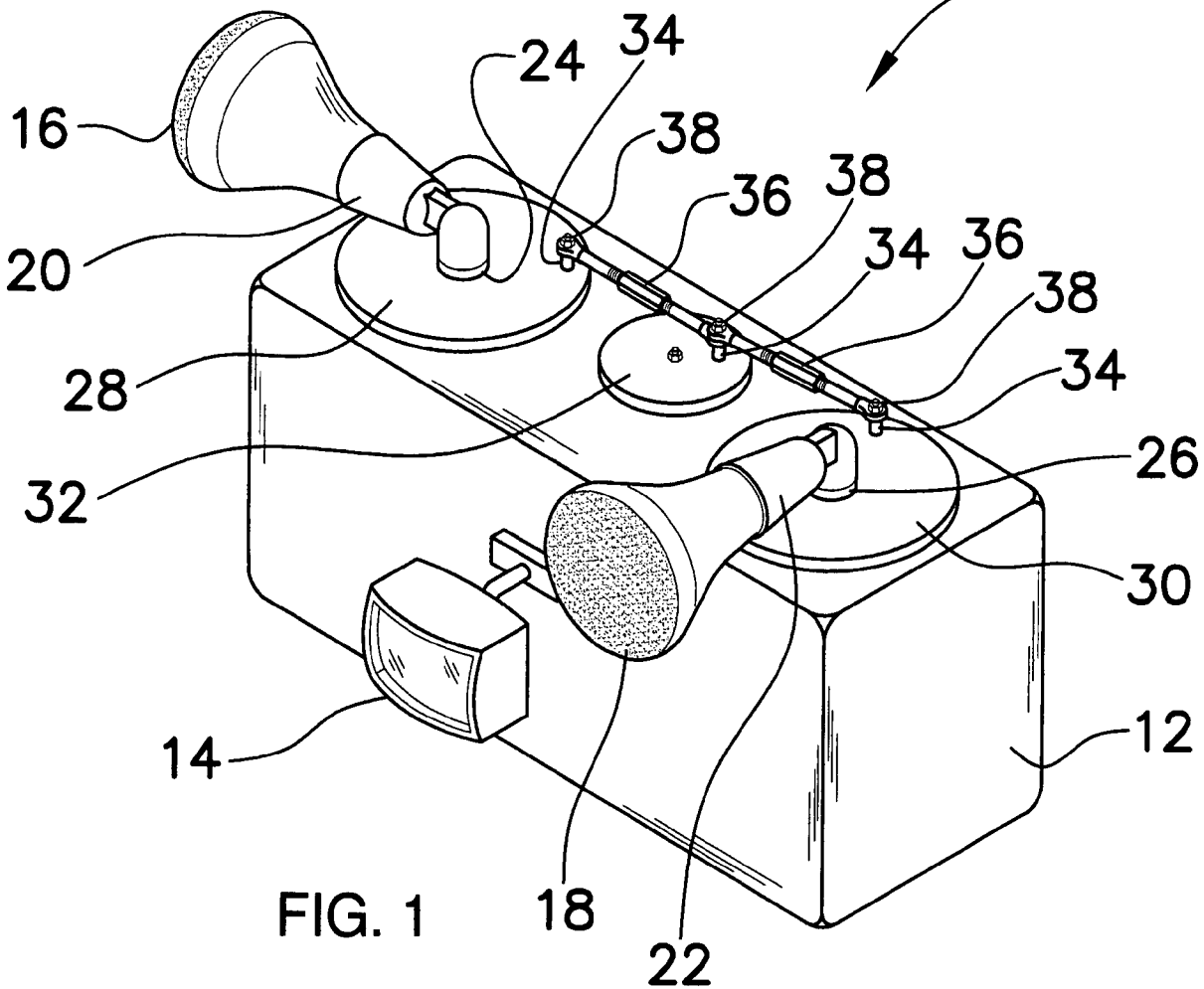
FIG. 1 is a perspective view of a security device with rotating floodlights constructed in accordance with the principles of the present invention.

Referring to the drawings in general and FIG. 1 in particular, an embodiment of the present invention 10 will now be described in greater detail. A housing 12 having a top surface, a bottom surface, side walls, a front wall, a back wall, and having an open cavity defined by the walls, has a motion detector 14 mounted on the outside of the front wall. The structure of suitable motion detectors are well known in the prior art and will not be described in detail here. The housing 12 can be formed of a variety of materials, although metal and plastic are preferred. A pair of lamp sockets 20, 22, configured to accept flood lights 16, 18 or comparable light bulbs are mounted on a pair of lamp base platforms 28, 30. Attachment mechanisms 24, 26 engage the lamp sockets 20, 22 to the base platforms 28, 30. The lamp sockets 20, 22 are pivotally mounted on the base platforms 28, 30, and can be adjusted to allow for different fields of view for the flood lights 16, 18. The attachment mechanisms 24, 26 are preferably locking nuts.

Figure 4:
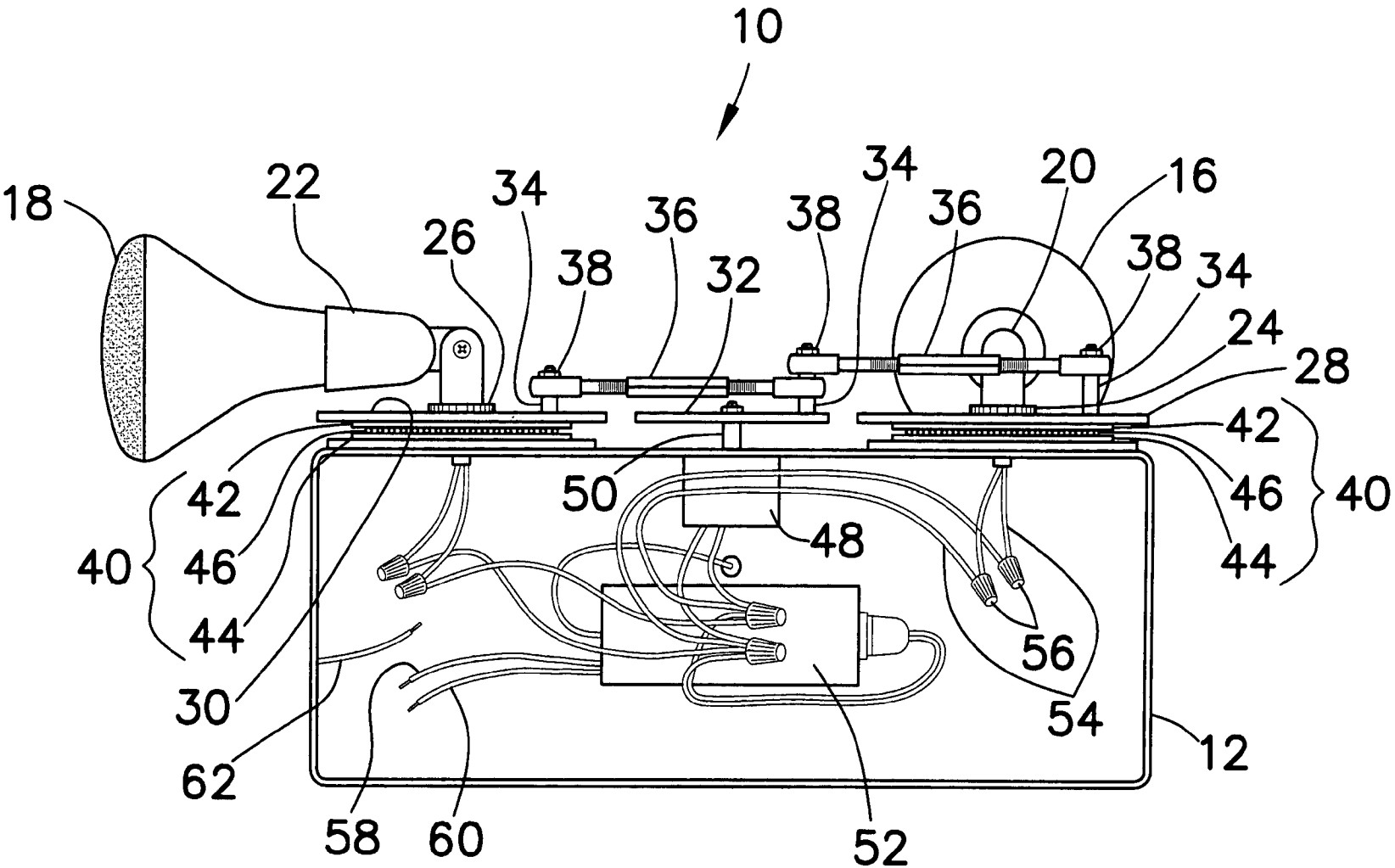
FIG. 4 is a rear cross-sectional view of the invention with a back wall of a housing removed and showing a control circuit and a motor.
Figure 5:
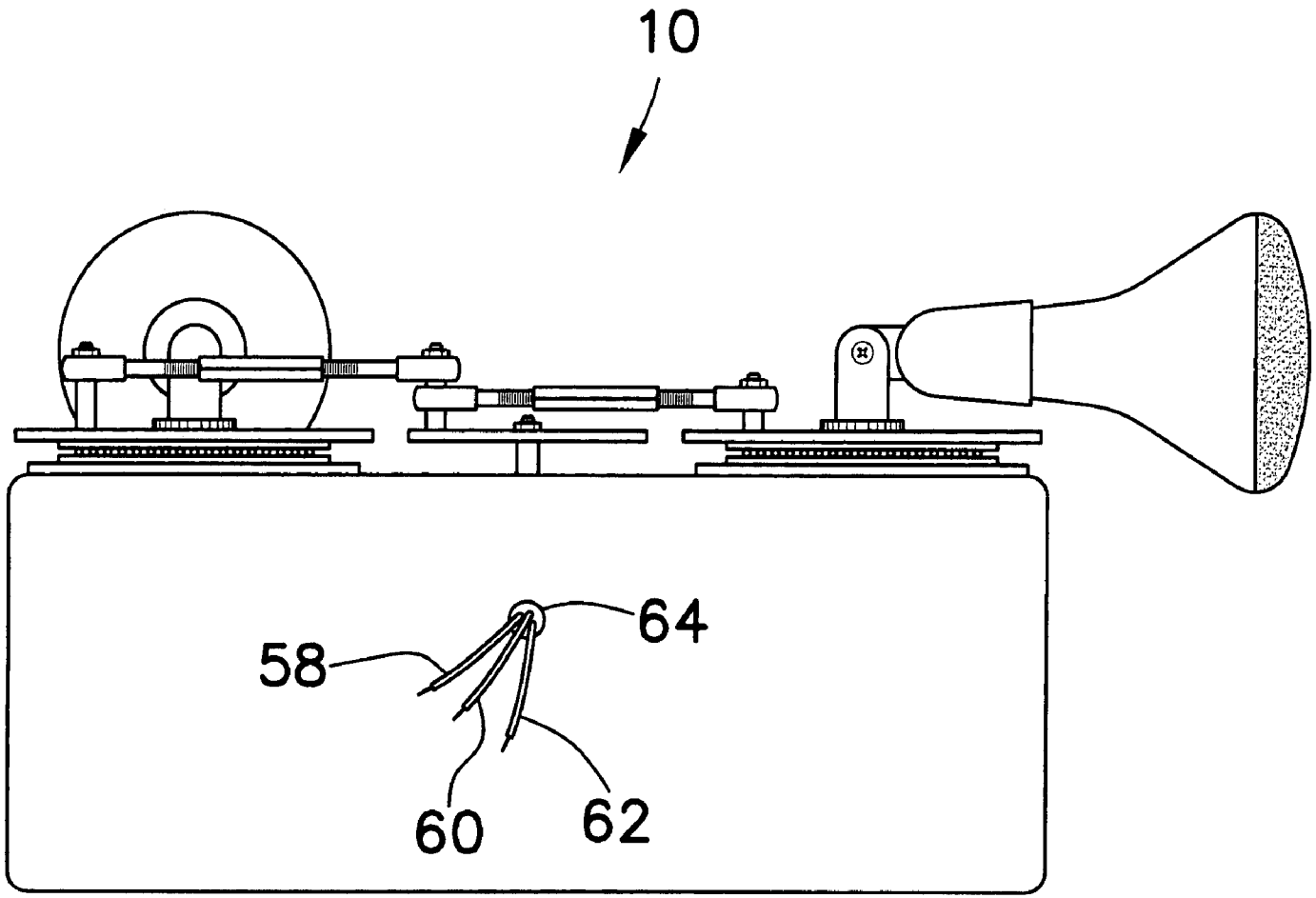
FIG. 5 is a rear elevation view of the invention with the back wall in place and showing a live wire, a neutral wire and a ground wire extending through a grommet.

As shown in FIG. 4, a control circuit 52 is positioned inside the cavity of the housing 12. Wiring 54, with electrical connections 56, allows the control circuit 52 to be electronically coupled to the lamp sockets 20, 22 and a motor 48. The motor 48 is a single speed gear motor, preferably a one revolution per minute (r.p.m.) gear motor. A motor shaft 50 extends from the top surface of the motor 48 through an opening in the top wall of the housing 12. Wiring 54 passes through additional openings in the top wall of the housing 12 to couple with the lamp sockets 20, 22. The control circuit 52 is electronically connected to a 110V power source typical in electrical boxes in residential housing. A live wire 58, neutral wire 60 and a ground wire 62 provide the connection to the power source. When the housing 12 is metal, ground wire 62 is permanently mounted to the housing 12. When the housing 12 is not conductive, the ground wire 62 is wired to the control circuit 52 and other components. As further illustrated in FIG. 5, a rubber grommet 64 is provided through which the wires 58, 60, 62 extend, and connect to the power source.

The motor shaft 50 is engaged with a drive platform 32. Turntables 40 are permanently mounted on the top wall of the housing 12. The lamp base platforms 28, 30 are secured to the turntables 40. The turntables 40 are preferably comprised of a top plate 42 and a bottom plate 44 with ball bearings 46 there between. Other configurations of turntables 40 are possible subject to efficient rotational movement.

As further illustrated in FIGS. 2-5, a post 34 is fixed at a first end to an upper surface of the drive platform 32. Posts 34 are also fixed to an upper surface of each lamp base platform 28, 30. A pair of linkages 36, each having a first end and a second end is connected to the posts 34. The second ends of the linkages 36 are connected to the posts 34 affixed to the lamp base platforms 28, 30, and the first ends of the linkages 36 are connected to the post 34 affixed to the drive platform 32. The first and second ends of the linkages 36 form openings to allow for the connection to the posts 34. The linkages 36 are secured to the posts 34 by lock nuts 38. The linkages 36 are of equal length. In the preferred embodiment the linkages 36 resemble turnbuckles; however the shape and dimension of the linkages 36 can vary, subject to the spacing of the lamp base platforms 28, 30 and drive platform 32, and subject to efficient translation of rotary movement of the motion shaft 50 and turntables 40.

Figure 2:
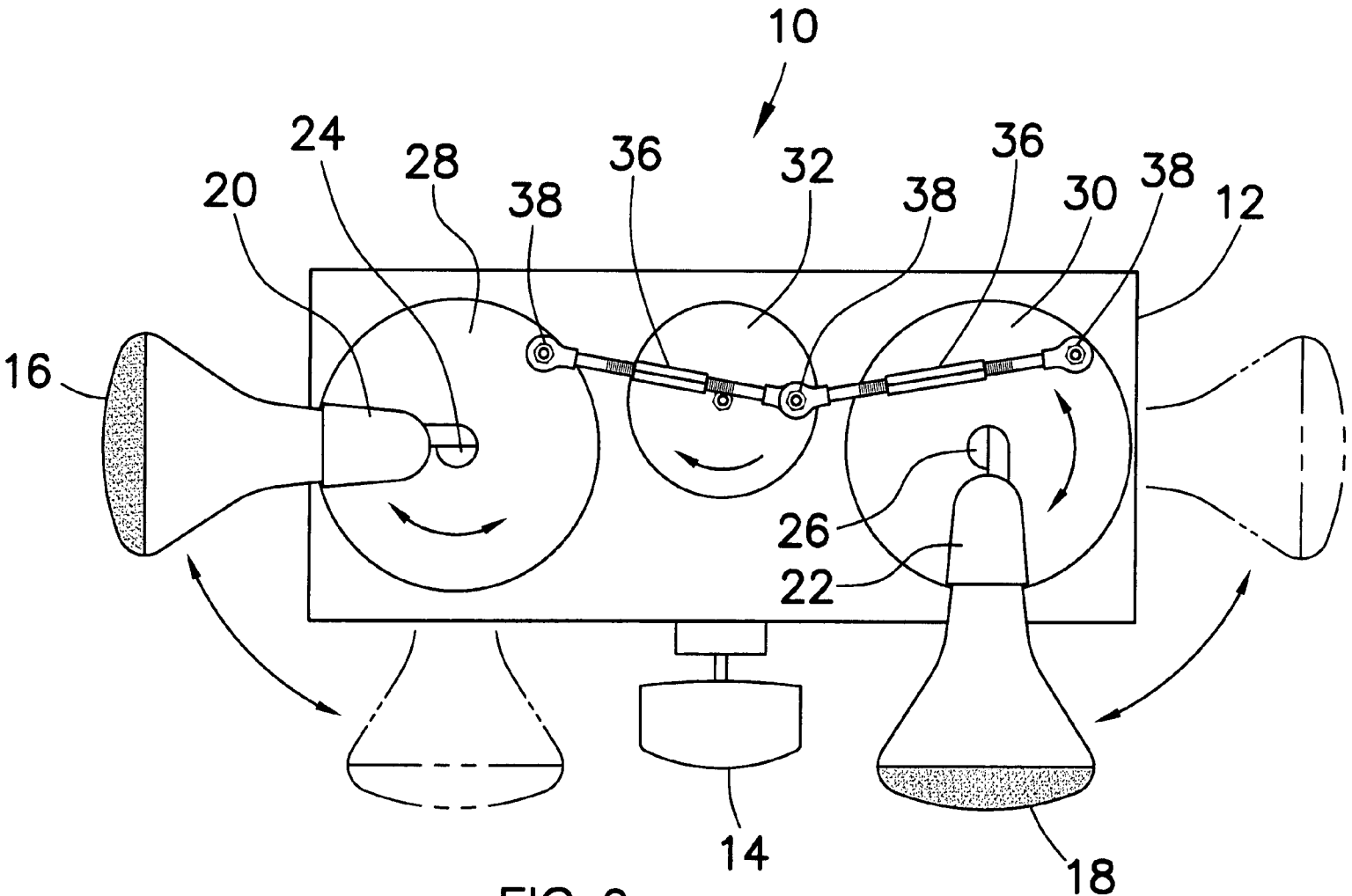
FIG. 2 is a top plan view of the present invention showing the relative movement of the lights.
Figure 3:
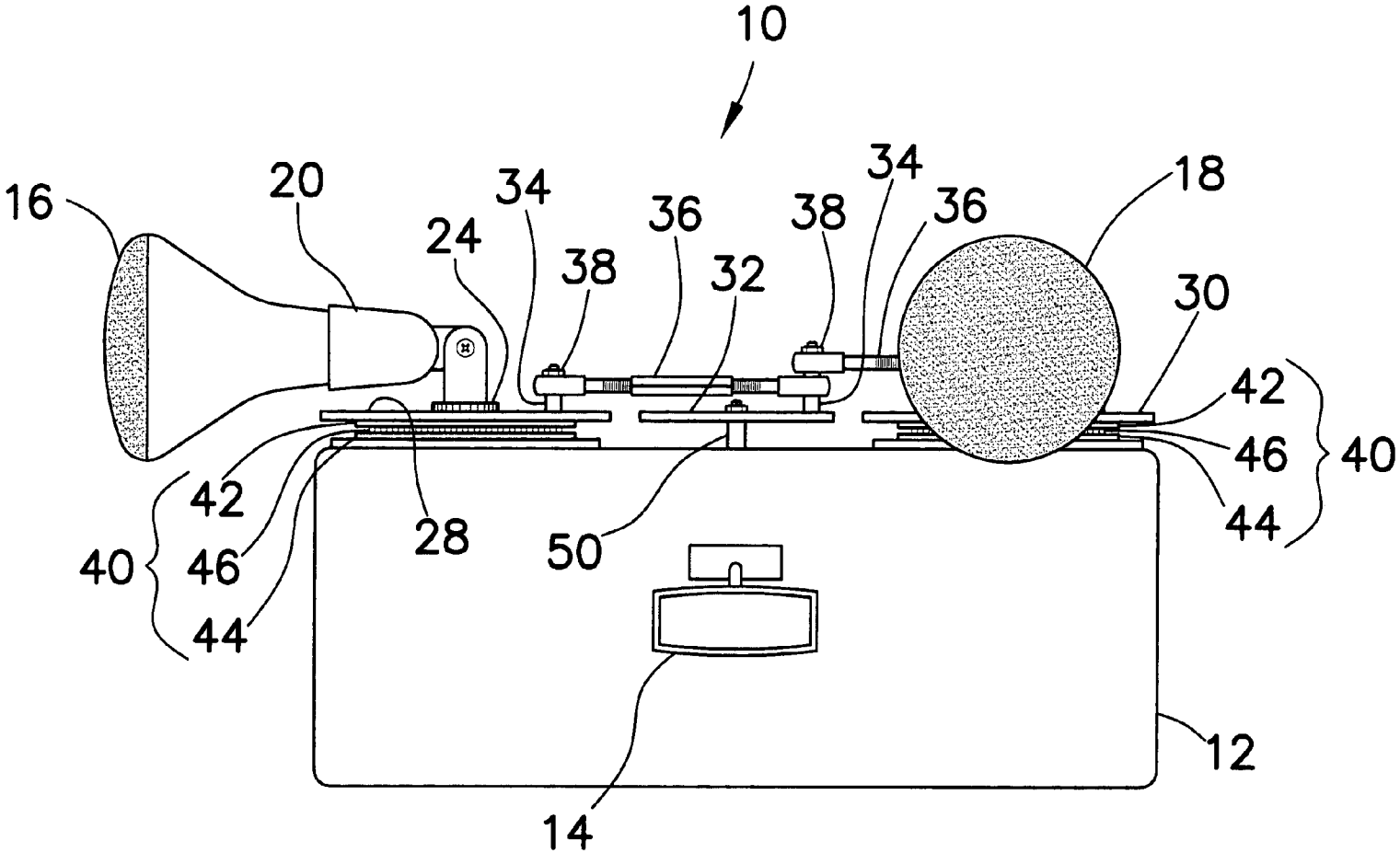
FIG. 3 is a front elevation view of the invention.

As further illustrated in FIG. 2, the lamp base platforms 28, 30 mounted on the turntables 40 rotate in either clockwise or counterclockwise manner, and the drive platform 32 engaged to the motor shaft 50 rotates in a clockwise manner. In the preferred embodiment the motor 48 turns the drive platform 32 a complete turn in one minute. The lamp sockets 20, 22 are positioned ninety degrees apart, and remain at this angle from each other during the operation of the device 10. As an example of the operation of the device 10 the post 38 fixed to the drive platform 32 starts at the twelve o'clock position. After the motion detector 14 activates the device 10, the post 38 fixed to the drive platform 32 moves in a clockwise manner. When the post 38 fixed to the drive platform 32 has moved to the three o'clock position, the lamp sockets 20, 22, with the lights 16, 18, will have turned to a different position, but remain ninety degrees apart. The lamp sockets 20, 22 will remain at a constant angle relative to each other because the linkages 36 are equal size, and thus the posts 38 fixed to the lamp base platforms 28, 30 sweep in equal arcs in the same time period. As the post 38 fixed to the drive platform 32 reaches the six o'clock position, the turntables 40 will begin to move in the opposite direction. The drive platform 32 will continue to turn clockwise until the twelve o'clock position is reached, at which point the lamp sockets 20, 22 will be at the original start position. Thus the lights 16, 18 travel through 90° of arc in thirty seconds, and then reverse course to the start position. The lights 16, 18 in combination provide 180° of illumination coverage for security.

The structure of the control circuit 52 is well known in the prior art and can be programmed. Depending upon the needs of the user of the device 10, the control circuit 52 can set the duration of illumination provided by the lights 16, 18, for instance at one, three or five minutes. When a wireless remote device is used instead of the motion detector 14 to activate the device 10, the user can turn the lights 16, 18 alternatively off/on as needed.

In the preferred embodiment of the device 10, the motor 48 turns the motor shaft 50 at one r.p.m. The lights 16, 18 perform a complete operation in one minute. Alternatively other motors could be provided with various speeds to change the duration of the operation of the device 10.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. A security device with rotating floodlights, comprising in combination:

a housing having a top surface, a bottom surface, side walls, a front wall, a back wall, and having an open cavity defined by the walls;

a motion detector mounted on the front wall of the housing;

a control circuit located in the cavity of the housing, and electronically coupled to the motion detector;

a motor located in the cavity, having a top surface and a bottom surface, and being electronically coupled to the control circuit;

a motor shaft extending from the top surface of the motor;

a drive platform having a top surface and a bottom surface, the bottom surface being engage with the motor shaft;

a first turntable and a second turntable, the turntables having a top surface and a bottom surface, and the bottom surface of the turntables being permanently mounted on the top wall of the housing;

a first lamp base platform and a second lamp base platform, the lamp base platforms having a top surface and a bottom surface, the bottom surface of the first lamp base platform being secured to the top surface of the first turntable, and the bottom surface of the second lamp base platform being secured to the top surface of the second turntable;

a first lamp socket pivotally mounted on the top surface of the first lamp base platform for receiving a flood light, a second lamp socket pivotally mounted on the top surface of the second lamp base platform for receiving a flood light or the like, and the lamp sockets being electronically coupled to the control circuit;

a first flood light connected to the first lamp socket, and a second flood light connected to the second lamp socket;

at least three posts, each post having a first end and a second end, the first end of a first post fixed to the top surface of the drive platform, the first end of a second post fixed to the top surface of the first lamp platform and the first end of a third post fixed to the top surface of the second lamp platform;

a first linkage and a second linkage, each linkage having an opening defined at a first end and a second end, the first end of the linkages being secured to the second end of the first post, the second end of the first linkage being secured to the second end of the second post and the second end of the second linkage being secured to the second end of the third post; and as the control circuit receives an appropriate signal generated by the motion detector, the control circuit operates to power the lights and engage the motor to rotate the motor shaft in a clockwise manner.

2. The rotating illumination device of claim 1, wherein the turntables are comprised of a top plate, a bottom plate and ball bearings positioned between the top plate and the bottom plate.

3. The rotating illumination device of claim 1, wherein the housing is metal.

4. The rotating illumination device of claim 1, wherein the housing is plastic.

5. The rotating illumination device of claim 1, where the linkages are turnbuckles.

6. A security device with rotating floodlights, comprising in combination:

a housing having a top surface, a bottom surface, side walls, a front wall, a back wall, and having an open cavity defined by the walls;

a motion detector mounted on the front wall of the housing;

a control circuit located in the cavity of the housing, electronically coupled to the motion detector, and having a ground wire, a live wire and a neutral wire electronically connected to a power source;

a motor located in the cavity, having a top surface and a bottom surface, and being electronically coupled to the control circuit;

a motor shaft extending from the top surface of the motor;

a drive platform having a top surface and a bottom surface, the bottom surface being engage with the motor shaft;

a first turntable and a second turntable, the turntables having a top surface and a bottom surface, and the bottom surface of the turntables being permanently mounted on the top wall of the housing;

a first lamp base platform and a second lamp base platform, the lamp base platforms having a top surface and a bottom surface, the bottom surface of the first lamp base platform being secured to the top surface of the first turntable, and the bottom surface of the second lamp base platform being secured to the top surface of the second turntable;

a first lamp socket pivotally mounted on the top surface of the first lamp base platform for receiving a flood light, a second lamp socket pivotally mounted on the top surface of the second lamp base platform for receiving a flood light or the like, and the lamp sockets being electronically coupled to the control circuit;

a first flood light connected to the first lamp socket, and a second flood light connected to the second lamp socket;

at least three posts, each post having a first end and a second end, the first end of a first post fixed to the top surface of the drive platform, the first end of a second post fixed to the top surface of the first lamp platform and the first end of a third post fixed to the top surface of the second lamp platform;

a first linkage and a second linkage, each linkage having an opening defined at a first end and a second end, the first end of the linkages being secured to the second end of the first post, the second end of the first linkage being secured to the second end of the second post and the second end of the second linkage being secured to the second end of the third post; and as the control circuit receives an appropriate signal generated by the motion detector, the control circuit operates to power the lights and engage the motor to rotate the motor shaft in a clockwise manner.

* * * * *